US006712227B2

(12) United States Patent
Blumreich et al.

(10) Patent No.: US 6,712,227 B2
(45) Date of Patent: Mar. 30, 2004

(54) FOLDABLE MERCHANDISING STRIP

(75) Inventors: Kristi M. Blumreich, New London, WI (US); Chad R. Sedo, Appleton, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 10/077,050

(22) Filed: Feb. 12, 2002

(65) Prior Publication Data

US 2003/0150827 A1 Aug. 14, 2003

(51) Int. Cl.[7] ..... A47F 5/00
(52) U.S. Cl. ..... 211/113; 211/118; 206/482
(58) Field of Search ..... 211/118, 85.29, 211/113, 72, 57.1, 59.1, 73; 206/806, 482, 45.14; 248/214, 74.1, 220.41, 49, 51, 73, 205.3, 300, 316.2

(56) References Cited

U.S. PATENT DOCUMENTS 1,524,170 A * 1/1925 Carson ..... 206/482
2,043,070 A * 6/1936 Rutkowski ..... 206/482
4,360,103 A * 11/1982 Armstrong ..... 206/482
4,817,805 A * 4/1989 Rodriquez ..... 211/85.15
5,096,070 A * 3/1992 Jaynes ..... 211/85.15
5,103,970 A 4/1992 Nielson et al.
5,199,578 A * 4/1993 Pendergraph et al. ..... 211/72
5,386,916 A * 2/1995 Valiulis ..... 211/113
5,553,721 A * 9/1996 Gebka ..... 211/59.1
5,762,212 A * 6/1998 Pomerantz ..... 211/113
5,794,800 A * 8/1998 Carmo et al. ..... 211/113
6,006,929 A * 12/1999 Leonard ..... 211/113
6,382,569 B1 * 5/2002 Schattner et al. ..... 248/74.1

* cited by examiner

*Primary Examiner*—Blair M. Johnson
*Assistant Examiner*—Jennifer E. Novosad
(74) *Attorney, Agent, or Firm*—Quarles & Brady LLP

(57) ABSTRACT

A foldable merchandising strip comprises an elongated flexible strip segmented into sections by a plurality of horizontal fold lines. A hanging assembly comprising an upwardly directed retaining tab and a downwardly directed retaining tab is provided in alternate fold sections. Packages including a slot or aperture are hung on the upwardly directed retaining tab, and the downwardly directed retain tab is folded over the bottom edge of the aperture, the retaining tabs restrict movement of the package.

28 Claims, 4 Drawing Sheets

FOLDABLE MERCHANDISING STRIP

BACKGROUND

Merchandising strips for hanging packages of merchandise for display are common in retail establishments. Typically, these strips include a plurality of hooks, tabs, or clips to which packaged merchandise can be selectively attached and removed by a customer. These strips are particularly useful in providing a merchandise display near check-out lines and cash registers, allowing purchasers to select additional products while standing in line.

While merchandise strips of the type described above are suitable to provide a display of packaged products, there are a number of disadvantages associated with these types of product displays. For example, to refill the display, it is necessary for an employee to physically hang the packages on the clips or hooks of the strip. Maintaining the display therefore can be time consuming, labor-intensive, and expensive. Retailers, therefore, prefer merchandising strips which are pre-loaded with products, such that products can be displayed with a minimal amount of labor.

Pre-stocked merchandising strips, however, pose a challenge to the producers and shippers of products. Pre-stocked merchandising strips, for example, add an additional step to the production process, requiring additional labor and therefore adding cost to the product. Furthermore, pre-stocked strips can be difficult to package, particularly when products are of an irregular shape or size. Additionally, hanging items which are not well-secured can shift during shipping, causing damage to the products and the associated strip, and causing the weight of the package to shift.

Because of these problems, a sub-industry of "jobbers" has developed. Jobbers buy in bulk, load products on strips, then deliver the loaded strips to retailers. Jobbers, however, do not provide an acceptable solution to problems associated with merchandising strips because they add additional cost to the product, increase the lead time for delivery of products, and complicate the maintenance of stock for merchandisers.

There remains a need, therefore, for a satisfactory method for packaging and shipping products on a merchandise strip.

SUMMARY OF THE INVENTION

The present invention is a foldable merchandising strip which, when folded, provides a compact package of products for shipping and, when unfolded, provides a hanging display of products. The merchandising strip is particularly well suited for use in conjunction with products packaged in packages that include an elongated aperture or slot at an upper end for hanging the product to a hook or other mounting device.

The merchandising strip of the present invention generally comprises an elongated strip separated into fold sections by a plurality of horizontal fold lines provided across the width of the strip. The fold lines are disposed at spaced intervals along the length of the elongated strip, such that the merchandising strip can be fan-folded for shipping. A pair of retaining tabs for hanging the product and for limiting movement of the package during shipping are disposed in alternate fold sections. One of the retaining tabs is directed upward for receiving the upper edge of an aperture in a package, and the other retaining tab is directed downward for folding over the lower edge of the aperture.

In use, the product is coupled to the merchandising strip by sliding the aperture or slot in the package over the first, or upwardly-directed retaining tab until the upper edge of the aperture rests against the retaining tab. The second, or downwardly-directed retaining tab is then folded over the lower edge of the aperture. The upwardly-directed retaining tab limits motion of the package in a downwardly vertical direction, while the downwardly-directed retaining tab limits motion of the package in an upwardly vertical direction. The width of the upwardly-directed retaining tab can be selected to be substantially equivalent to that of the aperture in the package, such that the upwardly-directed retaining tab further limits motion of the package horizontally.

For shipping, the merchandising strip is fan-folded to provide a small, stable, and easy-to ship package in which layers of products are aligned and maintained in position both horizontally and vertically by the retaining tabs. Upon receipt at a retail outlet, a merchandiser unfolds the merchandising strip. The products can then be hung from a hook or other mounting device for display.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENT

Figure 1:
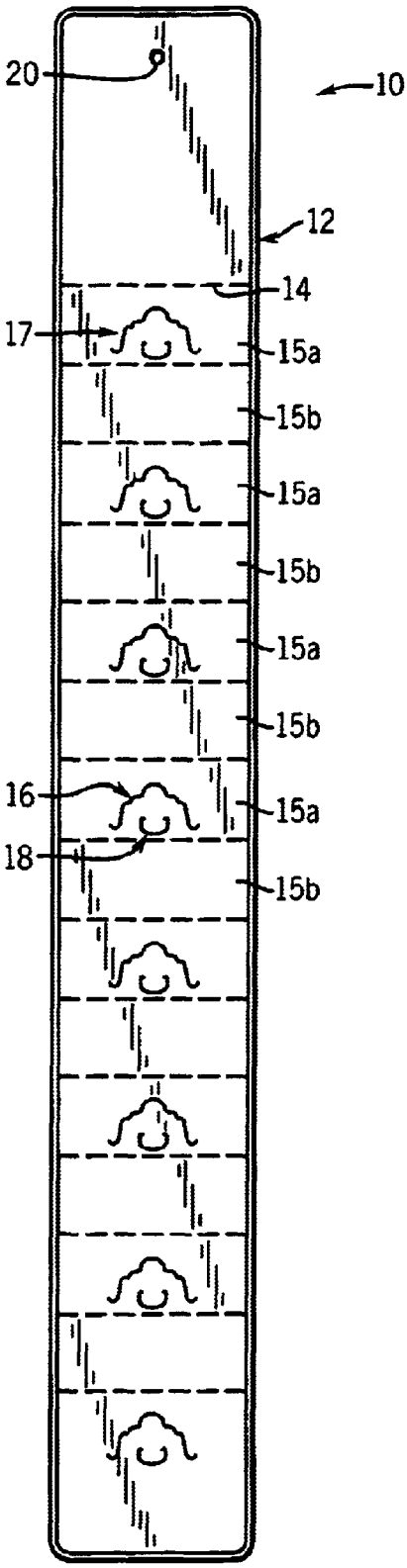
FIG. 1 is a front view of a merchandising strip constructed in accordance with the present invention.

Referring now to the figures and more particularly to FIG. 1, a collapsible shipping and display device 10 constructed in accordance with the present invention is shown. The collapsible shipping and display device 10 is constructed from an elongated strip 12 comprised of a flexible but sufficiently stiff, disposable material such as cardboard or plastic. The elongated strip 12 includes a plurality of horizontal fold lines 14 dividing the elongated strip 12 into a plurality of fold sections 15*a* and 15*b*. The horizontal fold lines 14 can be, for example, perforation lines or creases in the strip 12. An aperture 20 for receiving a mounting device for hanging the elongated strip 12 is provided at an end of the elongated strip 12.

Alternate fold sections 15*a* include a hanging assembly 17. Each hanging assembly 17 comprises an upwardly directed retaining tab 16 and a downwardly directed retaining tab 18 as will be described more fully below. Between each fold section 15*a* is a fold section 15*b* which allows fan folding of the elongated strip 12 to form pleats as described more fully below.

Figure 2:
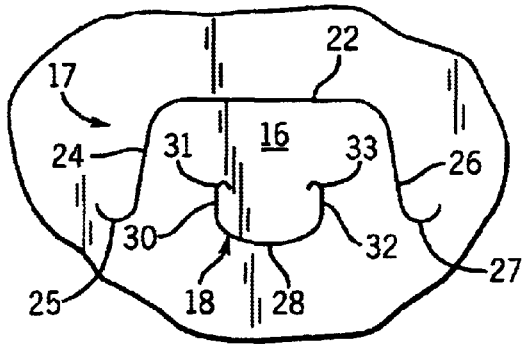
FIG. 2 is a front view of a first embodiment of a hanging assembly constructed in accordance with the present invention.

Referring now to FIG. 2, the upwardly directed retaining tab 16 generally comprises an inverted U-shaped cut in the elongated strip 12. The U-shaped cut comprises a base section 22 and first and second arms 24 and 26. The length of the base section 22 is preferably selected to mate with an aperture 46 in a package 44 (FIG. 4) to be hung on the hanging assembly 17 such that horizontal movement of the package is minimized, as described below. The base section 22 is preferably positioned a sufficient distance from the horizontal fold line 14 to allow the retaining tab 16 to be folded over a package even if the elongated strip 12 is folded or partially folded as described below. The arms 24 and 26 preferably slope outwardly toward the adjacent side of the strip 12 as they extend from the base section 22 to an endpoint 25 and 27 respectively of the arms 24 and 26, such that the base section 22 is narrower than the distance between the endpoints 25 and 27. The endpoints 25 and 27 of the upwardly directed tab 16 are curved upward toward the base section 22, thereby distributing the weight of the package over a wider area of the strip 12 and minimizing the possibility of tearing as the downward weight of a package 44 is applied.

Referring still to FIG. 2, the downwardly directed retaining tab 18 is also a generally U-shaped cut comprising a base section 28 and first and second arms 30 and 32. The base section 28 of the downwardly directed retaining tab 18 is narrower than that of the upwardly directed retaining tab 16, and is sized and dimensioned to fold over an aperture 46 in a package 44 (FIG. 4) to be hung on the hanging assembly 17. An endpoint 31 and 33 of the arms 30 and 32 of the downwardly directed tab 18 extends vertically upward such that the endpoints 31 and 33 are at a higher vertical position than the endpoints 25 and 27 of the tab 16, and the endpoints 31 and 33 extend into the upwardly directed tab 16. Again, the endpoints of the downwardly directed tab 18 are curved toward the base section 28, thereby distributing the weight of the package over a wider area and preventing tearing as the downward weight of a package 44 is applied.

Figure 3:
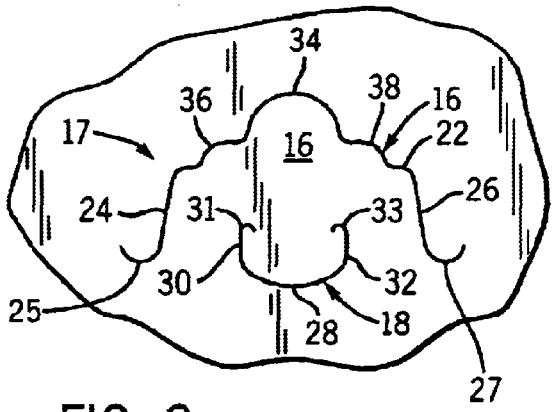
FIG. 3 is an enlarged front view of the hanging assembly of FIG. 1.

Referring now to FIG. 3, in a preferred embodiment the base section 22 of the upwardly directed retaining tab 16 is provided in a stepped configuration wherein the base section 22 includes a rounded center section 34 and two adjacent intermediate step sections 36 and 38. The center section 34 provides a high point at the center of the tab 16, and the adjacent intermediate sections 36 and 38 couple the center section 34 to the base 22, at an intermediate height between that of the center section 34 and base 22. The stepped configuration of the hanging assembly 17 of FIG. 3 reduces the size of the upper receiving edge of the upwardly directed tab 16, thereby minimizing the need to exactly align the aperture 46 in the package 44 with the retaining tab 16. Each of the "steps" in the step configuration are rounded thereby also minimizing sharp edges in the strip 12. In the preferred embodiment of FIG. 3, the downwardly directed retaining tab 18 is also rounded to eliminate any sharp edges. Other tab configurations, such as substantially V-shaped tabs, or tabs comprising varying numbers of steps are also possible.

Figure 4:
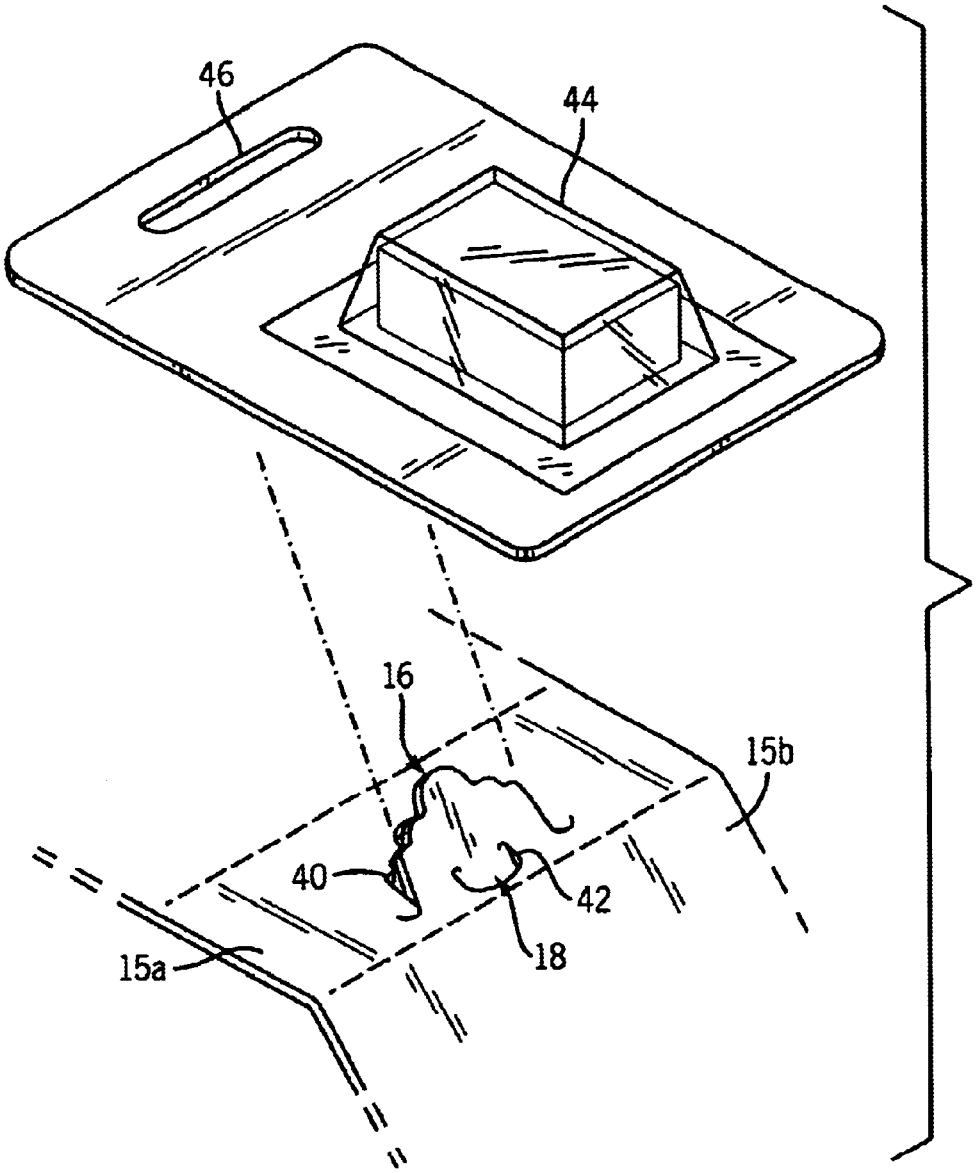
FIG. 4 is an enlarged perspective view of the hanging assembly of FIG. 3, folded to receive a package.
Figure 5:
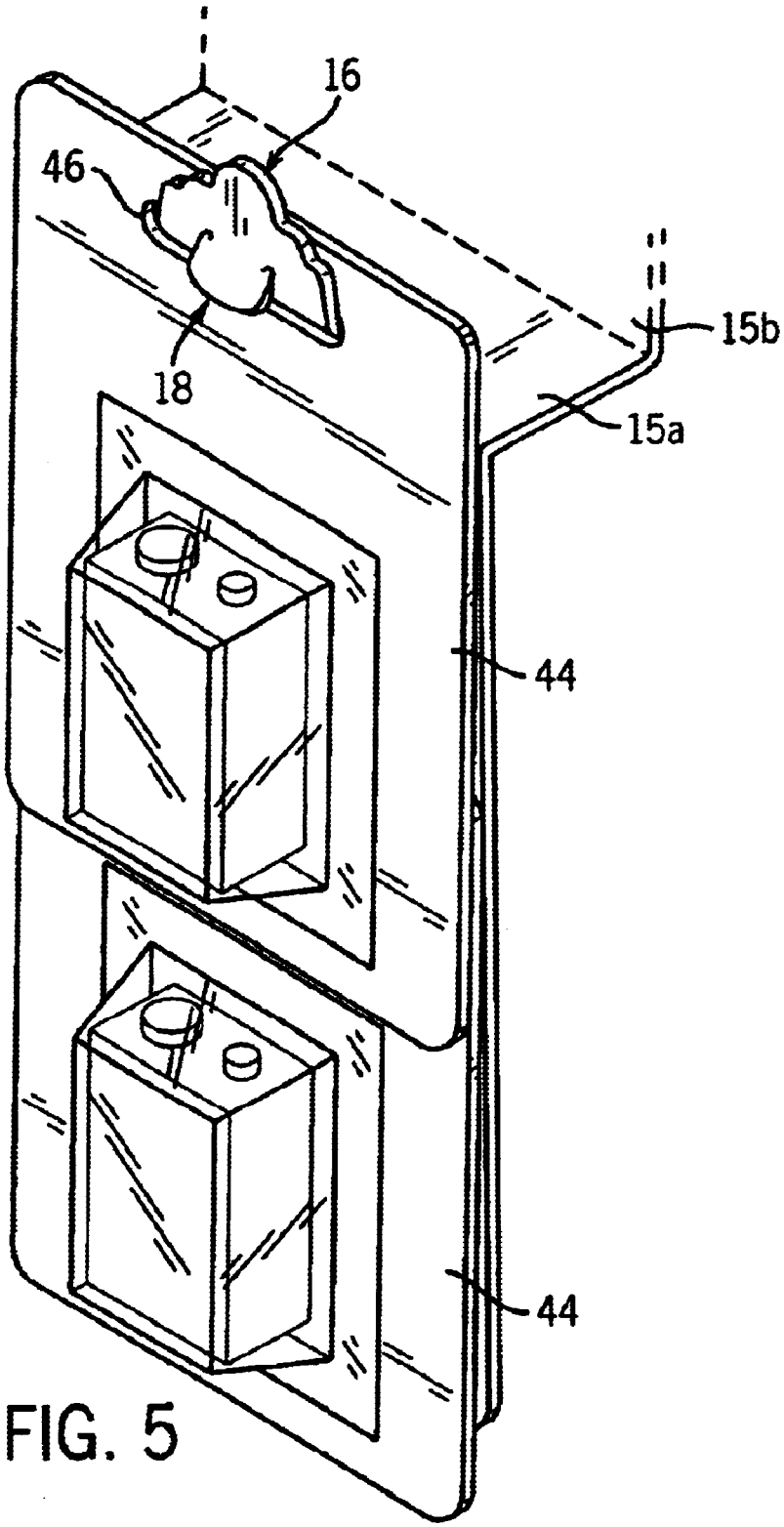
FIG. 5 is a partial front view of the merchandising strip of FIG. 1 with a package attached.

Referring now to FIG. 4, a side view of a fold section 15*a* is shown with the upwardly directed retaining tab 16 and the downwardly directed retaining tab 18 in an open position to receive a package 44. As the upwardly directed retaining tab 16 and downwardly directed retaining tabs 18 are folded away from the strip 12 to receive a package, a hole 40 and 42 is exposed beneath each retaining tab 16 and 18, respectively. Referring now to FIG. 5, a package 44 including an aperture 46 is slid over the upwardly directed retaining tab 16 until the top of the aperture 46 rests on the upwardly directed retaining tab 16. As noted above, the arms 24 and 26 of the upwardly directed retaining tab 16 slope inward. Therefore, at the top of the tab 16, the aperture 46 is wider than the tab 16. As the aperture 46 is slid over the tab 16, the package 44 comes to rest on the tab 16 at the point at which the width between the arms 24 and 26 exceeds the width of the aperture 46. When the package 44 is in place the downwardly directed retaining tab 18 is folded over the bottom edge of the aperture 46. In this position, the downwardly directed tab overlaps the bottom edge of the aperture, and the upwardly directed tab 16 overlaps the upper edge of the aperture. The downwardly directed retaining tab 18, therefore, minimizes motion of the package 44 in an upward direction, while the upwardly directed retaining tab 16 minimizes motion in a downward direction. As noted above, the width between the arms 24 and 26 of the upwardly directed retaining tab 16 can be selected to be substantially equivalent to the width of the aperture 46, thereby also minimizing motion of the package in a horizontal direction. Also as noted above, the distance between the base 22 of the retaining tab 16 and the fold line 14 is preferably selected to allow the aperture 46 to be slid onto the tab 16, even when the strip 12 is folded or partially folded.

Figure 6:
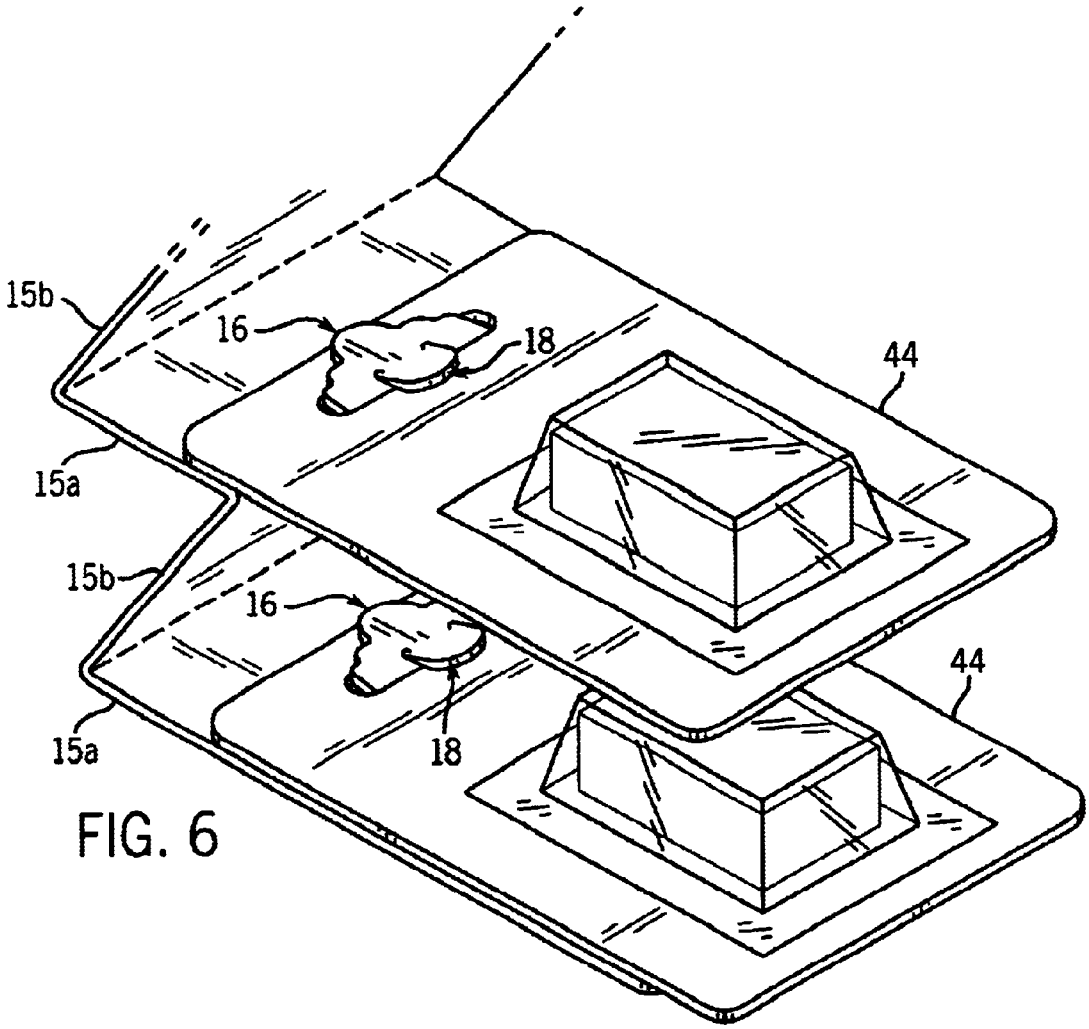
FIG. 6 is a partial side view of the merchandising strip of FIG. 5, wherein the merchandising strip is fan folded for shipping.

Referring now to FIG. 6, when a plurality of packages 44 are loaded onto the hanging assembly 17 associated with the elongated strip 12, the collapsible shipping and display device 10 can be fan folded for shipping. Here, the fold sections 15*b* are folded over the fold sections 15*a*, such that a plurality of the packages 44 are aligned in a stacked configuration for shipping. When provided in the fan-folded position, motion of each of the packages 44 is limited horizontally by the retaining tabs 16 and 18 as described above, thereby limiting shifting of the load in shipping. Upon receipt at a retail establishment, the collapsible shipping and display devise 10 is unfolded and hung from the aperture 20 to display merchandise.

Although preferred embodiments have been shown and described, it will be apparent to one of ordinary skill in the art that a number of modifications could be made to the method and apparatus described without departing from the scope of the invention. For example, more than one upwardly directed tab or downwardly directed tab could be used. Therefore "a" or "an" should be interpreted as "at least one" in the claims which follow, and not as only one. In addition the downwardly directed tab could overlap either the lower edge of the aperture, as in the embodiment illustrated, in the upper edge of the package. Either way the downwardly directed tab holds the package down. It should be understood, therefore, that the methods and apparatuses described above are only illustrative and do not limit the scope of the invention, and that various modifications could be made by those skilled in the art that would fall within the scope of the invention.

We claim:

1. An elongated strip for shipping and displaying a plurality of packages, each of the packages including an aperture for hanging the package, the elongated strip comprising:

a plurality of horizontal fold lines defined at spaced intervals in the elongated strip, the fold lines defining a plurality of fold sections; and a hanging assembly provided in alternate fold sections, each hanging assembly comprising:

at least one upwardly directed cut providing an upwardly directed retaining tab; and at least one downwardly directed cut in the strip providing a downwardly directed retaining tab, the downwardly directed cut being aligned directly below and separated a distance from the upwardly directed cut, wherein the upwardly directed retaining tab is adapted to restrict motion of the package in a vertically downward direction and the downwardly directed retaining tab is adapted to restrict motion of the package in a vertically upward direction.

2. The elongated strip as defined in claim 1, wherein the fold lines comprise perforations.

3. The elongated strip as defined in claim 1, wherein the fold lines comprise creases.

4. The elongated strip as defined in claim 1, wherein the retaining tabs are generally U-shaped.

5. The elongated strip as defined in claim 1, wherein the elongated strip comprises a disposable material.

6. The elongated strip as defined in claim 1, wherein the elongated strip comprises a cardboard material.

7. The elongated strip as defined in claim 1, wherein the upwardly directed retaining tab is adapted to overlap an upper edge of the aperture.

8. The elongated strip as defined in claim 1, wherein the downwardly directed retaining tab is adapted to overlap a lower edge of the aperture.

9. A collapsible display system for shipping and displaying a plurality of packages, each of the plurality of packages including an aperture therein for hanging the package, the collapsible display system comprising:

an elongated strip;

a plurality of horizontal fold lines defined at spaced intervals along the length of the elongated strip, the fold lines defining a plurality of fold sections; and a pair of retaining tabs disposed in alternate fold sections, the pair of retaining tabs comprising an upwardly directed retaining tab for receiving the upper edge of the aperture, and a downwardly directed retaining tab adapted to be folded over the lower edge of the aperture.

10. The collapsible display system as defined in claim 9, wherein the upwardly directed retaining tab is sized and dimensioned to prevent horizontal movement of the package.

11. The collapsible display system as defined in claim 9, wherein the upwardly directed retaining tab is generally U-shaped, comprising first and second arms and a base section, the base section being directed upward to receive the aperture.

12. The collapsible display system as defined in claim 11, wherein the distance between the end points of the first and second arms is selected to restrict horizontal movement of the package.

13. The collapsible display system as defined in claim 12, wherein the first and second arms are angled toward each other from each of the first and second endpoints such that a length of the base of the upwardly directed retaining tab is selected to restrict horizontal movement of the package.

14. The collapsible display system as defined in claim 11, wherein the downwardly directed retaining tab comprises first and second legs and a base section extending between the first and second legs, the end points of each of the first and second legs being disposed within the upwardly directed retaining tab.

15. The collapsible display system as defined in claim 11, wherein at least a portion of the downwardly extending retaining tab extends into the upwardly extending retaining tab.

16. The collapsible display system as defined in claim 9, wherein the upwardly extending retaining tab and the downwardly extending retaining tab are each formed with rounded corners.

17. The collapsible display system as defined in claim 9, wherein the upwardly directed tab is adapted to restrict motion of the package in a downward direction and the downwardly directed tab is adapted to restrict motion of the package in an upward direction.

18. The collapsible display system as defined in claim 9, wherein the downwardly directed tab is positioned below the upwardly directed retaining tab.

19. A method for providing a pre-loaded merchandising strip, the method comprising:

providing an elongated strip of a disposable material;

providing fold lines across the width of the strip at selected distances along the length of the strip to provide fold sections;

cutting in alternate fold sections:

at least one upwardly-directed cut to provide an upwardly directed tab in the fold section; and at least one corresponding downwardly-directed cut to provide a downwardly directed tab corresponding to and spaced below each upwardly directed tab;

sliding a package comprising an aperture over each upwardly directed tab until the upwardly directed tab rests over an upper portion of the aperture;

folding each downwardly directed tab over a lower edge of the aperture; and fan folding the elongated strip for shipping.

20. The method as defined in claim 19, further comprising the step of cutting an aperture at an end of the strip for hanging the strip.

21. The method as defined in claim 19, wherein providing fold lines comprises perforating the elongated strip.

22. The method as defined in claim 19, wherein the step of cutting comprises cutting tabs with rounded corners.

23. The method as defined in claim 19, wherein the step of cutting the upwardly directed tab comprises cutting an inverted U-shaped slit in the strip.

24. The method as defined in claim 23, further comprising the step of cutting the U-shaped slit in a stepped configuration, narrowing at a center section to facilitate slipping the aperture over the tab.

25. The method as defined in claim 19, wherein the upwardly facing edge of the package is a lower edge of the aperture.

26. The method as defined in claim 19, wherein the upwardly directed tab overlaps an upper edge of the aperture.

27. The method as defined in claim 19, wherein the downwardly directed tab overlaps a lower edge of the aperture.

28. The method as defined in claim 19, further comprising the step of cutting the downwardly directed cut below the upwardly directed cut.

* * * * *